US006062402A

United States Patent [19]

Ford

[11] Patent Number: 6,062,402

[45] Date of Patent: May 16, 2000

[54] MODULAR MERCHANDISING DISPLAY RACK

[75] Inventor: Allan L. Ford, Melrose Park, Pa.

[73] Assignee: Reborn Products Co., Ltd., Bensalem, Pa.

[21] Appl. No.: 09/356,280

[22] Filed: Jul. 16, 1999

[51] Int. Cl.[7] ..... A47F 5/00

[52] U.S. Cl. ..... 211/189; 211/181.1; 211/182

[58] Field of Search ..... 211/181.1, 189, 211/182, 163; 52/36.1, 36.4

[56] References Cited

U.S. PATENT DOCUMENTS

| | | | |
|---|---|---|---|
| 4,222,579 | 9/1980 | Frydendal | 211/181.1 X |
| 4,884,702 | 12/1989 | Rekow | 211/189 X |
| 4,915,462 | 4/1990 | Le Marchand et al. | 211/181.1 X |
| 4,981,226 | 1/1991 | Shallenberg et al. | 211/189 |
| 5,016,405 | 5/1991 | Lee | 52/36.1 |
| 5,255,803 | 10/1993 | Pavone et al. | 211/189 |
| 5,378,056 | 1/1995 | Wilson et al. | 211/189 X |
| 5,524,394 | 6/1996 | Szabo et al. | 52/36.1 |
| 5,573,124 | 11/1996 | Frost | 211/181.1 |
| 5,785,190 | 7/1998 | Otema | 211/189 |

*Primary Examiner*—Robert W. Gibson, Jr.
*Attorney, Agent, or Firm*—Caesar, Rivise, Bernstein, Cohen & Pokotilow, Ltd.

[57] ABSTRACT

A modular rack system for displaying a plurality of items of merchandise. The system comprises plural support units for the merchandise and a rack assembly for mounting the support units. The rack assembly comprises a core frame unit, plural leg frame panels, and plural releasable connectors. The core frame unit has plural, e.g., four, side-wall panels, each of which is a planar grid of intersecting horizontal and vertical elongated rods. The side-wall panels of the core unit are fixedly secured to each other at respective corners of the core frame unit. Each of the plural frame panels is a generally rectangular, planar grid of intersecting horizontal and vertical elongated rods having at least one side edge. The releasable connectors each comprise a first connector element and a second connector element. Each of the leg frame panels has two of one of the connector elements fixedly secured to it. Each of the corners of the core frame unit has two of the other of the connector elements fixedly secured to it. The connector elements are arranged to be slid together to releasably mount each of the leg frame panels to any corner of the core frame unit so that each frame panel is oriented at an angle to the contiguous side-wall panels of the core frame unit to thereby form an alcove into which a person may position himself/herself to view the items of merchandise on the rack system. The various support members are arranged to be releasably secured onto at least one of the horizontal rods of the grid of the core frame unit or any of the mounted frame panels.

15 Claims, 4 Drawing Sheets

FIG. 3
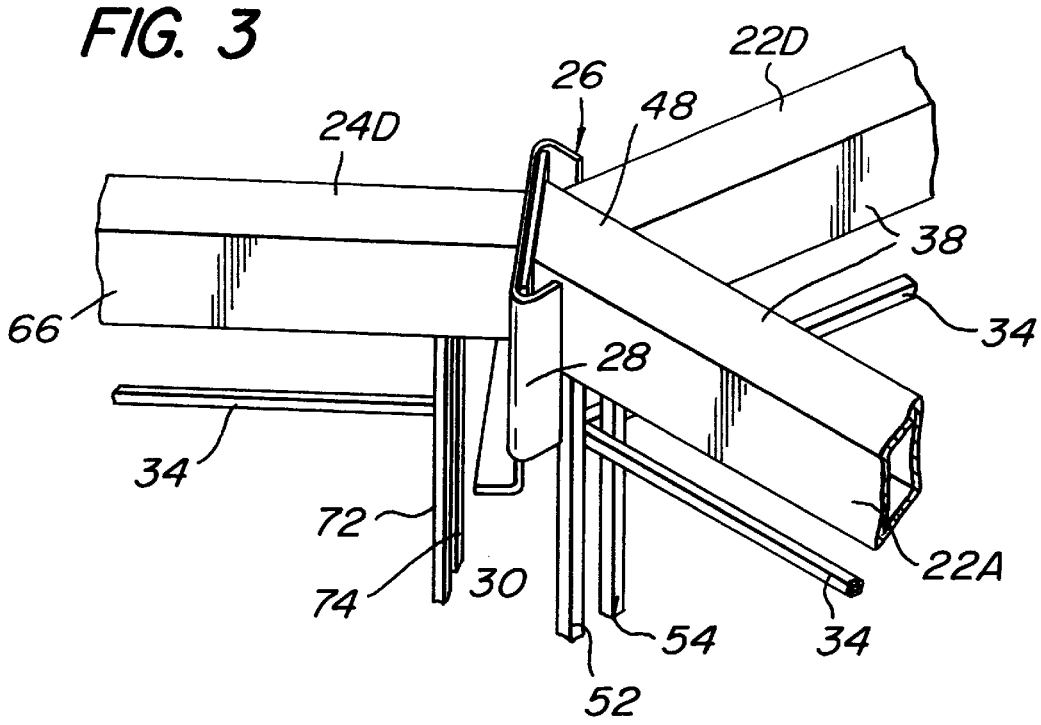
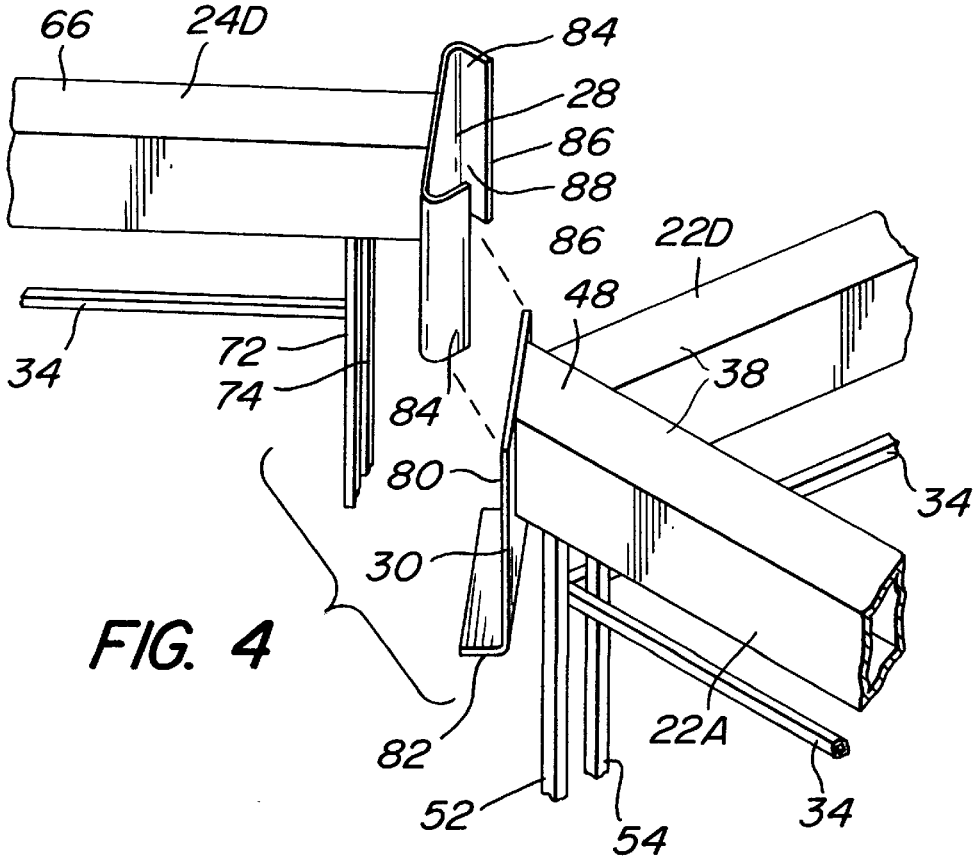
FIG. 4

64
100
60
58
62
36
34
24A
66
22
22B
38
400
66
24B
600
600
600
500
34
34
36
70
70
36
36
56
68
56
40
56
68
56

FIG. 6
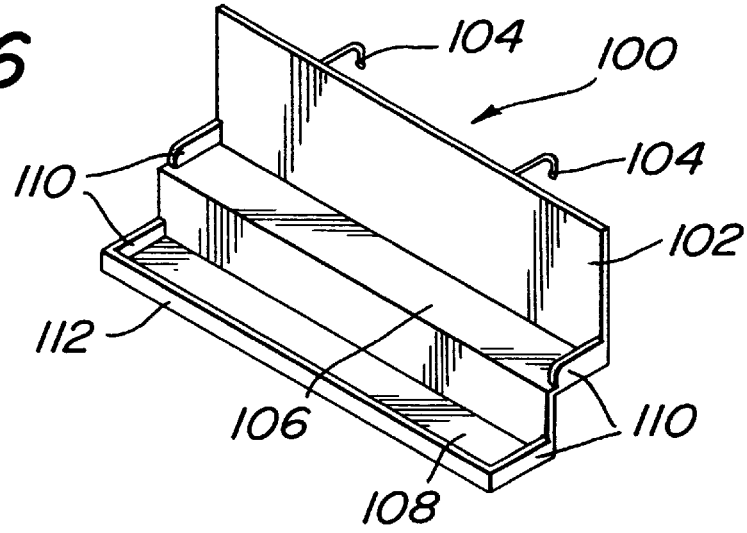
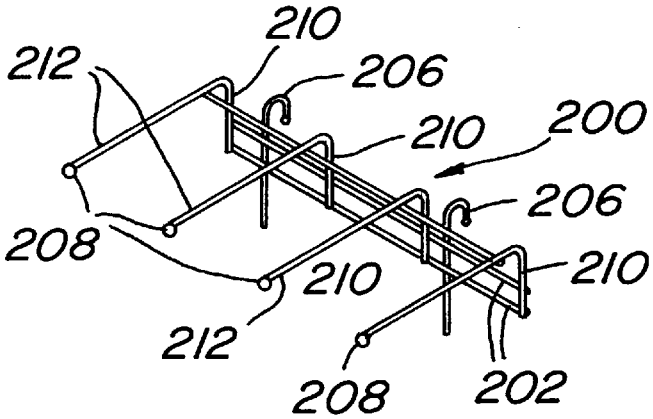
FIG. 7
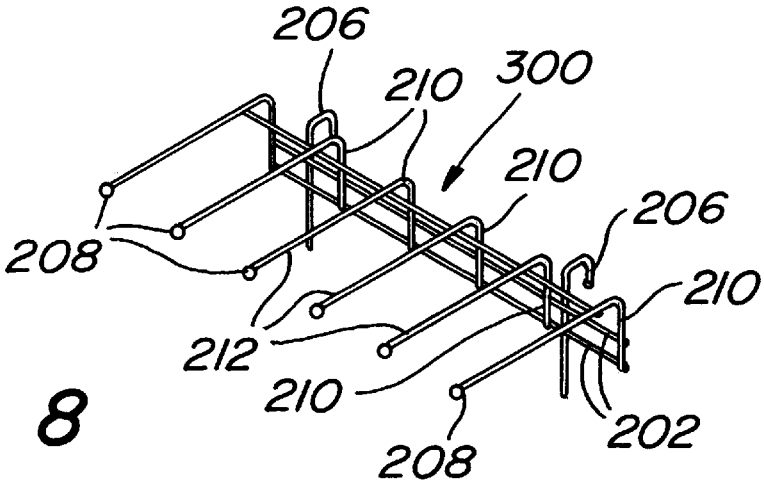
FIG. 8

MODULAR MERCHANDISING DISPLAY RACK

BACKGROUND OF THE INVENTION

This invention relates generally to a display fixture or rack, and more particularly, to a modular fixture or rack used for displaying and vending various items of merchandise, e.g., belts, suspenders, wallets, ties, etc.

Various items of merchandise, such as suspenders, belts, ties, wallets, etc.,are commonly vended by packaging them in boxes with transparent fronts, through which they are visible, or by suspending them from display racks. The advantage of displaying them on a rack, as opposed to packaging them in boxes, is that a customer can view and feel or otherwise closely inspect them without the necessity of removing them from a box.

One of the problems of utilizing the display fixtures or racks which are presently in use is that they are not sufficiently modular to enable easy assembly into a wide variety of configurations and to enable their easy disassembly into compact units for storage and transportation. Moreover, the prior art merchandising display fixtures or racks, when assembled and filled, tend to fail to focus the prospective purchasers vision to the display of the items supported thereon and to minimize the viewing of any distractions (e.g., other adjacent merchandising racks or displays).

OBJECTS OF THE INVENTION

It is accordingly an object of this invention to provide a modular merchandising rack system which overcomes the disadvantages of the prior art.

It is a further object of this invention to provide a modular merchandising rack system which can be assembled into a plurality of different configurations.

It is a further object of this invention to provide a modular merchandising rack system which is easy to assemble and disassemble.

It is a further object of this invention to provide a modular merchandising rack system which is simple in construction.

It is a further object of this invention to provide a modular merchandising rack system, which when assembled is arranged to support a plurality of different merchandise hangers or supports in various configurations.

It is a further object of this invention to provide a modular merchandising rack system, which when assembled provides expansive display areas for a plurality of items of merchandise to enable easy viewing and inspection by prospective purchasers.

It is a still a further object of this invention to provide a modular merchandising rack system which provides visually isolated display areas for a plurality of items of merchandise to enable undistracted viewing and inspection by prospective purchasers.

It is yet a further object of this invention to provide a modular merchandising rack system which, when disassembled is reasonably compact to facilitate storage and transportation.

SUMMARY OF THE INVENTION

These and other objects of this invention are accomplished by providing a modular merchandising rack system for displaying a plurality of articles, e.g., belts, suspenders, wallets, neck ties, etc., so that they can be readily seen and inspected by prospective purchasers. The system comprising at least one preferably numerous) hanger or support members and a rack assembly for the hanger member(s). Each hanger support is configured for supporting at least one of the articles of merchandise thereon. The rack assembly comprises a core frame unit, plural, e.g., four, leg frame panels, and plural, e.g., eight, releasable connectors for releasably mounting selected ones of the plural frame panels on the core frame unit. Each of the plural releasable connectors is made up of a first connector element, e.g., a plate with a bottom flange or lip, and a second connector element, e.g., a channel-shaped bracket having a slot.

The core frame unit comprises an integral hollow member having four side-wall panels. Each of the side-wall panels is in the form of a planar grid of intersecting horizontal and vertical elongated linear rods. The side-wall panels of the core unit are fixedly secured to each other at respective corners of that unit. Each of the plural leg frame panels is a generally rectangular, planar member formed of a grid of intersecting horizontal and vertical elongated linear rods. Each leg frame panel includes an outside edge and an inside edge. At least one of the first and second connector elements are fixedly secured to the inside edge of each leg frame panel. Each of the corners of the core frame unit of the system includes at least the other of said first and second connector elements fixedly secured thereto.

The first and second connector elements of each of the plural releasable connectors are arranged to be slid with respect to each other to releasably secure them together, e.g., the plate of the first connector element can be slid into the channel-shaped bracket member of the second connector element until the bottom flange of the plate supports the channel-shaped member thereon, whereupon each of the frame panels may be releasably secured to any corner of the core frame unit. When so mounted, each leg frame panel is oriented at an angle to the core frame unit side-wall panels contiguous with the corner to form an alcove into which the prospective purchaser may go to inspect the items of merchandise displayed from the system.

The at least one hanger or support is arranged to be releasably secured onto at least one of the horizontal rods of the grid of the core frame unit or any of the mounted frame panels.

DESCRIPTION OF THE DRAWINGS

Other objects and many of the attendant advantages of this invention will become readily appreciated as the same becomes better understood by reference to the following detailed description, when considered in connection with the accompanying drawing, wherein:

FIG. 3 is an enlarged isometric view of the portion of the system shown within the area designated "FIG. 3" in FIG. 1 and showing how one of the leg frame panels of the system is mounted on the core frame unit of the system;

FIG. 4 is an exploded isometric view, similar to FIG. 3, but showing the assembly/disassembly of the frame panel component on the core frame unit;

FIG. 6 is an enlarged isometric view of one type of hanger or support component, e.g., a shelf for holding at least one wallet for selective mounting on any of the panels making up the modular merchandising rack assembly of FIG. 1;

FIG. 7 is an enlarged isometric view of another type of hanger or support component, e.g., a 4-prong unit for belts, suspenders, ties or hankies for selective mounting on any of the panels making up the modular merchandising rack assembly of FIG. 1; and FIG. 8 is an enlarged isometric view of still another type of hanger or support component, e.g., a 6-prong unit for belts, suspenders, ties or hankies for selective mounting on the modular merchandising rack assembly of FIG. 1.

DETAILED DESCRIPTION OF THE PREFERRED EMBODIMENT

Figure 1:
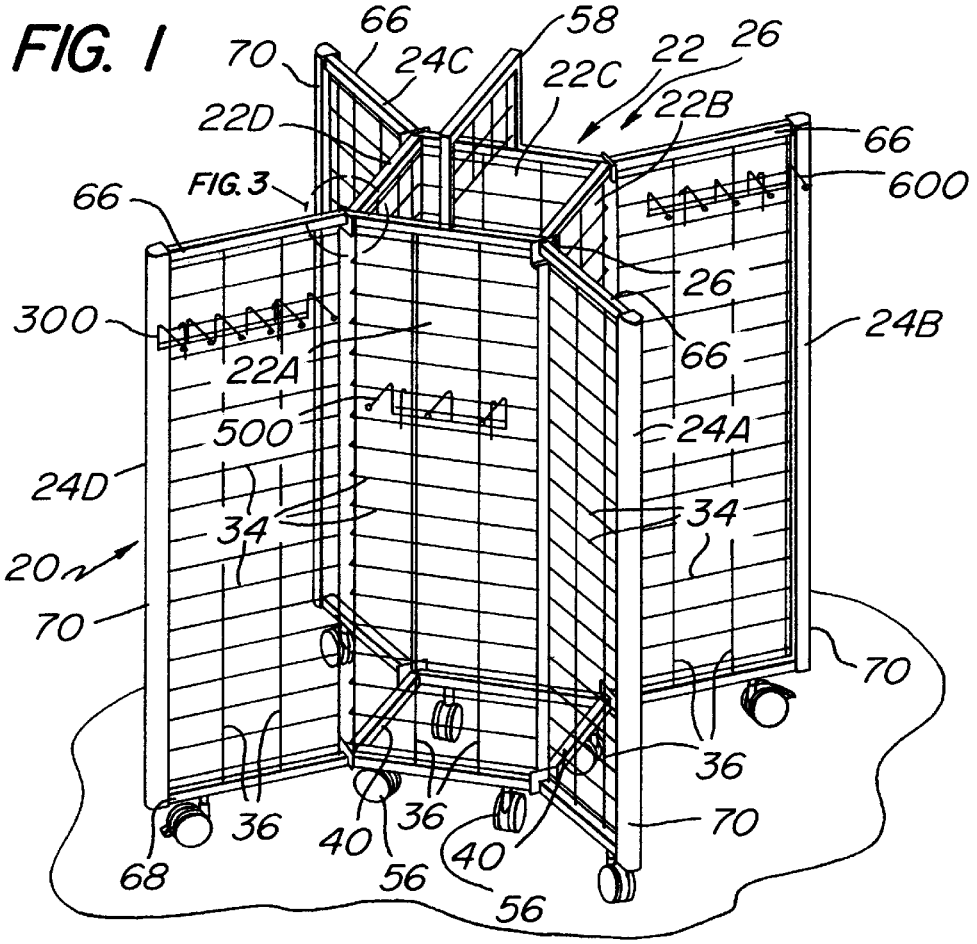
FIG. 1 is an isometric view of one embodiment of the modular merchandising display rack system of the subject invention and which system includes a core frame unit and four modular leg frame panels releasably mounted thereon unit.

Referring now in greater detail to the various figures of the drawing, wherein like reference characters refer to like parts, there is shown generally at 20 in FIG. 1 a modular fixture or rack system used for displaying and vending various items of merchandise, e.g., belts, suspenders, wallets, ties, hankies, etc. (not shown). The fixture/rack system 20 basically comprises a central core frame unit 22 and plural, e.g., four, planar leg frame panels 24A, 24B, 24C, and 24D arranged to be releasably secured and mounted onto the core frame unit in various configurations.

As will be described in detail later the core frame unit is a hollow member made up of plural planar side panels which merge with one another at respective outside corners. In the preferred embodiment shown there are four such side panels 22A, 22B, 22C, and 22D, which form a hollow square frame when viewed from the top or bottom of the unit (see FIG. 2). It should be pointed out at this juncture that this arrangement is merely exemplary of any number of different geometric shapes the side wall panels forming the core unit frame can be arranged to form. Thus, the core unit frame may be of rectangular, triangular, pentagonal, hexagonal, etc., shape. Moreover, the core frame unit may not even include any planar panels, but may be in the form of a circular or oval cylinder or some other regular or irregular shape.

In order to mount one or more of the leg panels 24A–24D onto the core unit 22, the system 20 also includes a plurality, e.g., eight, releasable connector assemblies 26 (see FIGS. 1–4). The construction of those connector assemblies will be discussed in detail later. Suffice it for now to state that each connector assembly 26 includes a pair of cooperating connector elements, namely, a first (e.g., bracket-type) connector element 28 and a second (e.g., plate-type) connector element 30. The two elements of each connector assembly are arranged to slidingly engage each other to releasably secure them together to mount the associated leg frame panel on the core frame unit.

As mentioned above the exemplary embodiment of the core frame unit basically comprises four planar panels 22A, 22B, 22C, and 22D. Each panel is a generally rectangular planar member formed of a grid of plural horizontally disposed linear wires or rods 34 and plural vertically disposed linear wires or rods 36. In the embodiment shown the wires or rods are of square cross section, but such a construction is merely exemplary. Thus, the wires or rods forming the grid may be solid or hollow and may be of any cross-sectional shape, e.g., square, circular, triangular, etc.

As best seen in FIGS. 2–5, the top portion of each side wall panel of the core frame unit 22 is designated by the reference number 38 and comprises a hollow tubular bar of square cross section. The top end of each of the vertically disposed wires 36 of the grid are secured, e.g., welded, to the top bar 38. The bottom portion of each panel of the core frame unit is designated by the reference number 40 and comprises a hollow tubular bar of square cross section, like the top bar. The bottom ends of each of the vertically disposed wires 36 of the grid are secured, e.g., welded, to the bottom bar 40.

In the exemplary embodiment 20, the side wall panels 22A–22D of the core frame unit 22 are connected together at four outside corners, 42, 44, 46, and 48, (see FIG. 2) so that each panel is perpendicular to the contiguous panel. Each corner is formed by the mitered joint of the contiguous top bars 38, the miter joint of the contiguous bottom bars 40 and a pair of vertically extending rods 52 and 54 (FIGS. 3 and 4). One outer end of the top bar 38 of panel 24A and one outer end of the top bar 38 of the panel 24B are fixedly secured, e.g., welded, together at a mitered joint forming the upper end of the outside corner 42. The other end of the top bar 38 of panel 24B and one outer end of the top bar 38 of the panel 24C are fixedly secured, e.g., welded, together at a mitered joint forming the upper end of the outside corner 44. The other end of the top bar 38 of panel 24C and one outer end of the top bar 38 of the panel 24D are fixedly secured, e.g., welded, together at a mitered joint forming the upper end of the outside corner 46. The other end of the top bar 38 of panel 24D and the other outer end of the top bar 38 of the panel 24A are fixedly secured, e.g., welded, together at a mitered joint forming the upper end of the outside corner 48. In a similar manner, one outer end of the bottom bar 40 of panel 24A and one outer end of the bottom bar 40 of the panel 24B are fixedly secured, e.g., welded, together at a mitered joint forming the lower end of the outside corner 42. The other end of the bottom bar 40 of the panel 24B and one outer end of the bottom bar 40 of the panel 24C are fixedly secured, e.g., welded, together at a mitered joint forming the lower end of the outside corner 44. The other end of the bottom bar 40 of panel 24C and one outer end of the bottom bar 40 of the panel 24D are fixedly secured, e.g., welded, together at a mitered joint forming the lower end of the outside corner 46. The other end of the bottom bar 40 of panel 24D and the other outer end of the bottom bar 40 of the panel 24A are fixedly secured, e.g., welded, together at a mitered joint forming the lower end of the outside corner 48.

The rods 52 and 54 are constructed like wires or rods 36 of the grid, but are disposed in a side-by-side arrangement closely spaced from each other to receive the outer ends of the horizontal cross wires 34 of the grid therebetween. The outer ends of the cross wires 34 are secured, e.g., welded in place, between the rods 52 and 54.

The corners 42,44,46 and 48 serve as the locations for releasably mounting the frame panels 24A–24D thereon, as will be described later.

Figure 2:
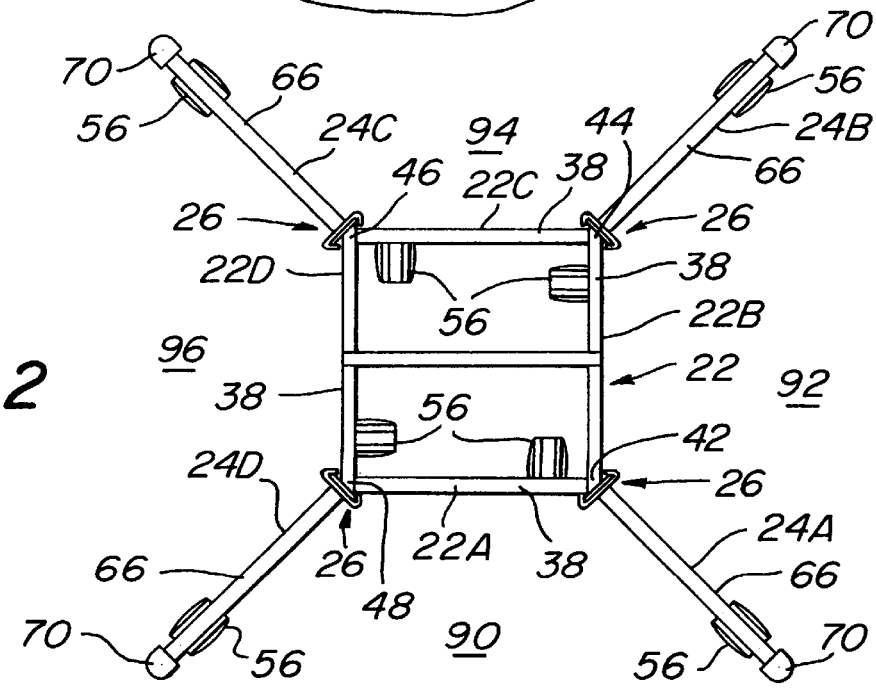
FIG. 2 is a top plan view of the embodiment of the system shown in FIG. 1.
Figure 5:
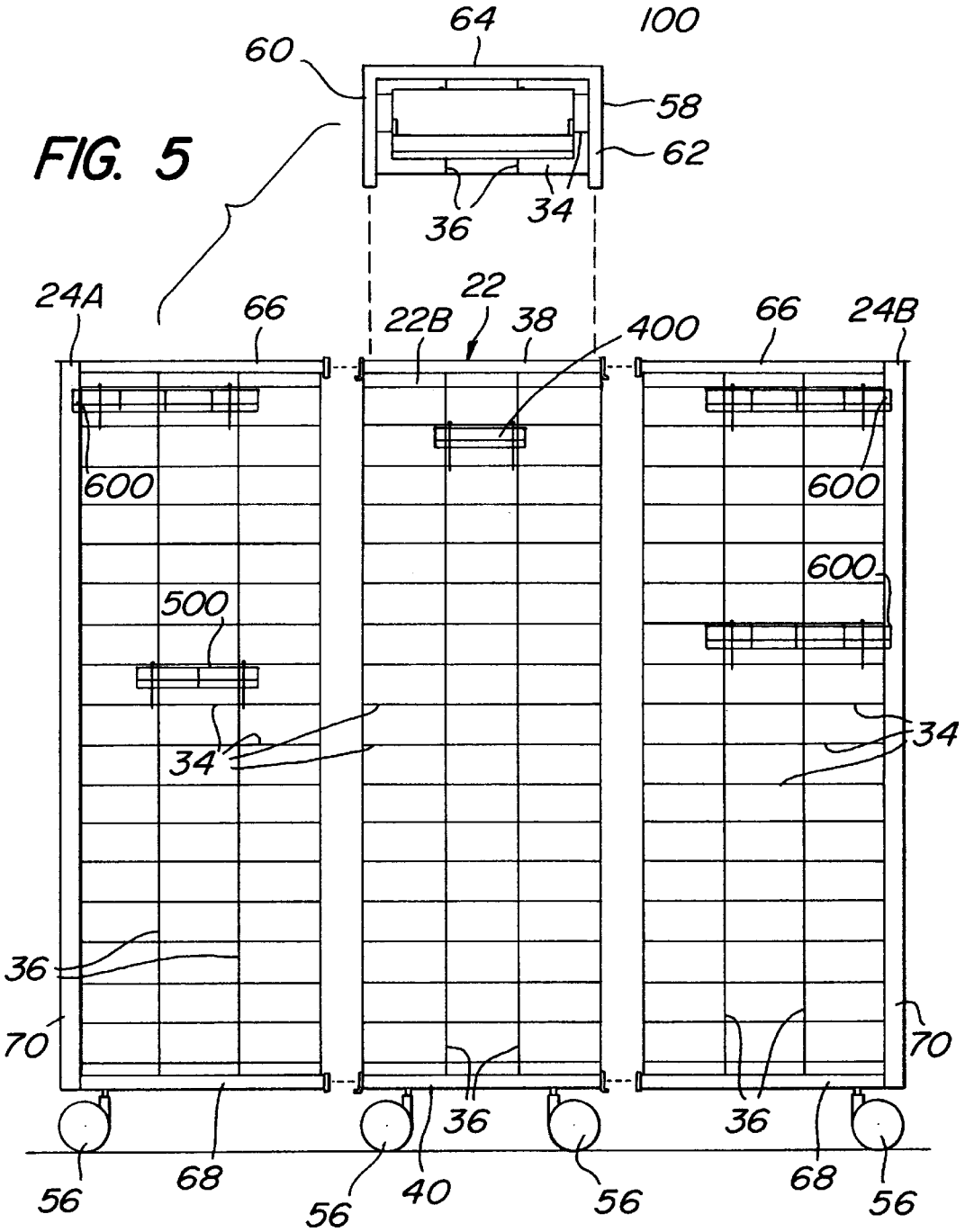
FIG. 5 is an exploded front elevational view of the system shown in FIG. 1.

In order to enable the core frame unit to be easily positioned at any desired location for displaying the merchandise thereon, e.g., to locate the frame unit at any particular place in a store, the core frame unit includes plural conventional casters 56 releasably mounted on the lower bars 38 of the side panels of the core frame unit as best seen in FIGS. 1, 2 and 5. With the casters in place, the core frame unit 22 can be readily rolled about. If desired, the casters 56 may include conventional locking tabs (not shown) to lock the casters in the desired position to prevent accidental displacement of the core frame unit once it is at the desired position. Each of the leg frame panels includes a conventional caster 56 releasably mounted on its bottom edge. Preferably the caster 56 on the leg frame panels include locking tabs.

As best seen in FIGS. 1 and 5 the core frame unit also includes a "header" or "topper" panel 58. This panel is arranged to releasably mount a support for an item of merchandise, e.g., a wallet supporting shelf unit (such as will be described later). In addition or alternatively the topper panel may be used to display advertising or other promotional material. The topper panel is releasably secured to the top of the core frame unit 22 so that it is readily visible to persons passing by the display rack 20 to draw their attention to the rack so that they will come closer for inspection of the items of merchandise displayed on the rack. To that end, the topper panel 58 is secured to the top bars of and opposed pairs of panels, e.g., opposed panels 22A and 22C, of the core frame unit 22. The topper panel itself is a planar, generally rectangular, panel made up of a supporting frame section and a wire grid. The frame section includes a pair of vertically oriented legs 60 and 62 (FIG. 5) and an interconnecting horizontal cross bar 64. The legs and cross bar are each formed of a hollow tubular bar stock of square cross section, with the lower end of the legs being secured, e.g., welded, to the top bar 38 of the opposed pair of side wall panels. Like the panels 22A–22D, the wire grid of the topper panel 58 is made up of plural horizontally disposed wires or rods 34 and plural vertically disposed wires or rods 36.

Each of the leg frame panels 24A–24D is identical in construction. Thus, only one panel 24A will be discussed in detail hereinafter. As best seen in FIGS. 1, 2 and 5 the panel 24A is a generally rectangular planar panel formed of a grid of plural horizontally disposed cross wires or rods 34 and plural vertically disposed wires or rods 36. The top portion of the panel 24A is designated by the reference number 66 and is in the form of a hollow tubular bar of square cross section. In a similar manner the bottom portion of the panel 24A is in the form of a hollow tubular bar 68 of square cross section, like the top bar 66. The top ends of each of the vertically disposed wires 36 of the grid forming the panel 24A are secured, e.g., welded, to the top bar 66, while the bottom ends of each of the vertically disposed wires 36 are secured, e.g., welded, to the bottom bar 68. The panel 24 also includes an outside frame section 70 formed of a hollow tubular bar of a generally D-shaped cross section. The outside frame section 70 extends vertically between and is secured, e.g., welded, to the outside ends of the top and bottom bars 66 and 68, respectively, of the panel 24A. As best seen in FIGS. 3 and 4 the opposite side of the panel 24A from the outside frame section 70 is formed by a pair of vertically extending rods 72 and 74 which are constructed like wires or rods 36, but are disposed in a side-by-side arrangement closely spaced from each other to receive the inner ends of the horizontal cross wires 34 of the grid therebetween. The inner ends of those cross wires are secured, e.g., welded in place, between the rods 72 and 74.

In accordance with the illustrated exemplary preferred embodiment of this invention, a pair of the bracket-type connector elements 28 are fixedly secured, e.g., welded, at the upper and lower ends of the inside edge of each of the panels 24A–24D. A cooperating pair of the plate-type connector elements 30 are fixedly secured, e.g., welded at the upper and lower ends of the respective corners of the core frame unit 22. The pair of bracket elements 28 on each leg frame panel 24A–24D are arranged for releasable, e.g., sliding, securement to respective ones of the pair of plate elements 30 on any of the corners 42, 44, 46 and 48 of the core frame unit to releasably mount the panel(s) on the core frame unit.

To that end, one of a pair of connector elements 28 is fixedly secured, e.g., welded, to the inner end of the upper bar 66 of the panel 24A, while the other of the pair of those elements is fixedly secured, e.g., welded, to the inner end of the bottom bar 40 of the panel. Other pairs of connector elements 28 are secured onto the panel 24B, 24C and 24D in a similar manner. A pair of connector elements 30 are located at each corner of the core frame unit by securing one of the elements 30 at the outer ends of the two upper bars 38 where they are mitered together and securing the other of the elements of that pair to the outer ends of the two lower bars 40 where they are mitered together. Other pairs of connector elements 30 are secured to the upper and lower bars of the panels 22B, 22C and 22D at the corners thereof in a similar manner.

Referring now to FIGS. 3 and 4, the details of the connector elements 28 and 30 of each connector assembly 26 will now be described. Thus, as can be seen the plate-type connector element 30 basically comprises a generally flat, rectangular plate 80 having a lip or flange 82 extending perpendicularly from the lower edge thereof. The bracket-type connector element 28 is a generally rectangular, channel shaped member having a pair of ears or flanges 84 projecting outward at an acute angle from the opposite sides of the member. The inside width of the bracket-type connector element at least slightly greater than the width of the plate 80 of the plate-type connector element 30. Moreover, the free ends 86 of the two flanges 84 are spaced from each other by a distance at least slightly less than the width of the plate 80 of the connector element 80 to form a throat 88 into which the plate element 30 may be slidably inserted.

Each panel 24A–24D is arranged to be mounted onto the core frame unit 22 by sliding its two bracket-type connector elements 28 over and into engagement with the two plate-type connector elements 30 on any outside corner of the core frame unit. For example, as seen in FIGS. 3 and 4, the pair of connector elements 28 on the inner edge of the panel 24D may be releasably secured onto the core frame unit at the corner 48 by lifting the panel 24A and orienting it so that each of its channel shaped bracket-type connector elements 28 is located above and axially aligned with the plates 30 forming the plate-type connector elements at the corner 48. This procedure is shown in the exploded isometric view of FIG. 4. Then the panel 24D can be lowered with respect to the core frame section 22, whereupon the pair of bracket elements 28 of the frame 24D slide over the plates 30 at the corner 48 of the core frame unit so that each plate 80 is within the throat 80 of the associated bracket element and so that the lower edges (not shown) of the respective bracket-type connector element, 28 are supported by the respective lips 82 of the plate-type connector elements 30 as shown in FIG. 3. The other leg frame panels 24B–24D can be similarly mounted on the core frame section 22.

The bracket-type connector elements 30 are mounted at the mitered corners of the upper and lower bars of the core frame section so that they extend at an angle of 45° to the side wall panels forming that corner. When any leg frame panel 24A–24D is mounted on the core frame section 22, it will lie in a plane extending at 45° to the plane of the core frame section panels contiguous with that corner. Thus, when all of the panels 24A–24D are mounted on the core frame section, a star-burst like structure, when viewed from above as seen in FIG. 2, results. Each panel 22A–22D of the core frame assembly and its two side-mounted leg frame panels 24A–24D form respective alcoves into which the consumer can position himself/herself to view and examine the articles of merchandise suspended or mounted on those panels. In the embodiment shown in FIG. 1, the panel 22A and the side panels 24A and 24D form an alcove 90, the panel 22B and the side panels 24A and 24B form an alcove 92, the panel 22C and the side panels 24B and 24C form an alcove 94, and the panel 22D and the side panels 24C and 24D form an alcove 96.

As can be seen in FIG. 1 the panels forming each alcove tend to direct the view of a person standing within the alcove to the merchandise located therein, while tending to block the person's view of adjacent structures. This feature has the effect of focusing the prospective purchaser's attention to the items of merchandise being displayed on the panels of the system 20 forming that alcove, while excluding from view any other visual distractions.

As will be appreciated by those skilled in the art the system 20 can be set up so that less than all of the panels 24A–24D are mounted on the core frame section in order to result in a display fixture of various shapes and sizes. Thus, the system can be configured so that none of the leg frame panels 24A–24B are mounted on the core frame unit 22, or else only one, two, or three of the leg frame panels are mounted thereon. For example, two leg frame panels 24A and 24B may be mounted on the core frame unit 22 at diametrically opposed corners or at adjacent corners. When mounted at diametrically opposed corners the two leg frame panels 24A and 24B will result in the creation of a fixture having a pair of alcoves, with one of the alcoves being made up of one side of the two leg frame panels 24A and 24B and the two core frame side wall panels located therebetween, and with the other of the alcoves being made up of being made up of the other side of the two leg frame panels 24A and 24B and the other two core frame side wall panels.

The means for suspending or mounting the various items of merchandise to be displayed by the system 20 within the various alcoves or on the panels of the core frame unit if no leg frame panels are used will now be considered by reference to FIGS. 1, and 5–8. Those means comprises variously sized and shaped hanger or support units. Each unit is arranged to be releasably mounted on any of the horizontally extending bars or wires 34 of any of the panels making up the system 20. For example in FIG. 6 there is shown a shelf unit 100 particularly suited for supporting and displaying plural wallets thereon. The unit 100 includes a back wall 102 from which a pair of hooks 104 project. The hooks are arranged to extend over any portion of the horizontal wires 34 making up the grids of any of the panels, e.g., the topper panel 58, whereupon the shelf unit's back wall its disposed vertically. Extending outward from the front of the back wall 102 is a pair of steps or ledges 106 and 108, each of which is arranged to support one or plural articles of merchandise, e.g., wallets, boxes of hankies, etc. The upper ledge 106 includes an opposed pair of upstanding flanges 110 on opposite ends thereof to prevent any merchandise on that ledge from slipping off the edge. The ledge 108 also includes an opposed pair of upstanding flanges 110 on opposite ends thereof and a front flange 112 to prevent any merchandise on that ledge from slipping off the edges or the front.

In FIG. 7 there is shown a 4-prong hanger unit 200 suitable for suspending neckties, belts, suspenders or hankies therefrom. The unit 200 has a back wall 202 formed of a pair of horizontally disposed wires 202 and 204 from which a pair of hooks 206 project. The hooks are arranged to extend over any portion of the horizontal wires 34 making up the grids of any of the panels, whereupon the hanger unit's back wall is disposed vertically. Extending outward from the front of the back wall 202 are four prongs 208. Each prong 208 has a vertically extending rear section 210 which is secured, e.g., welded to the wires forming the back wall 202 of the hanger and a horizontally projecting free end portion 212. The free end portions 212 of the prongs serve to enable one or plural items of merchandise to be suspended from each prong. For example, one of the prongs 208 may be used to support plural suspenders of one size therefrom, while another prong supports plural suspenders of another size, while another prong supports plural suspenders of yet another size, and the last prong supports plural suspenders of still another size.

In FIG. 8 there is shown an alternative embodiment of a hanger 300. The hanger 300 is similar in construction to the hanger 200, except that it includes 6 prongs. Thus, in the interest of brevity the components making up the hanger 300 will be given the same reference numbers as those components making up the hanger 200, and the details of their structure will not be reiterated. Other hanger units, such as 2, 3 and 5 prong unit 400, 500, and 600, respectively, shown in FIG. 5 are contemplated by this invention. In fact any number or type of units for holding and/or suspending articles of merchandise can be used with the system of the subject invention, in lieu of or in addition to the units 100–600 shown herein. Moreover, those units for suspending and/or supporting the items of merchandise can be mounted at various positions and orientations on the various panels making up the system of this invention. Thus, the particular shape, construction and orientation of the shelf and hanger components of this system are merely exemplary.

It should be pointed out at this juncture that if the core frame unit 22 is constructed of non-planar panels, e.g., arcuate, panels which merge with one another to form a hollow circular cylinder, that unit will not include any of the heretofore mentioned corners. In that case, the connector elements for mounting the panels thereto are mounted at spaced locations about the periphery of the core frame unit. For example, if the core frame unit is a hollow circular cylinder it will include upper and lower bars of circular profile (not shown) with plural pairs of connector elements 30 being located at 90 degree spacing from one another around the periphery of the upper and lower circular bars of the core frame unit. Thus, when the panels 24A–24d are mounted thereon, the resulting structure is also generally star-shaped, but the center panel of each alcove will be convex instead of being planar.

As should be appreciated from the foregoing the modular system of the subject invention thus provides the merchant with a display fixture that can be readily configured to any desired shape for best displaying the items of merchandise.

Without further elaboration, the foregoing will so fully illustrate my invention that others may, by applying current or future knowledge, readily adapt the same for use under various conditions of service.

I claim:

1. A modular merchandising rack system for displaying a plurality of items, said system comprising at least one support member for supporting at least one of the items and a rack assembly for releasably mounting said at least one support member thereon, said rack assembly comprising a core frame unit, plural leg frame panels, and plural releasable connectors for releasably mounting selected ones of said plural leg frame panels on said core frame unit, said core frame unit comprising an integral hollow member having plural side-wall panels, each of said side-wall panels being in the form of a grid of intersecting horizontal and vertical elongated rods, said side-wall panels being fixedly secured to each other at respective corners, each of said plural leg frame panels being a generally rectangular, planar member formed of a grid of intersecting horizontal and vertical elongated rods and having one side edge, each of said plural releasable connectors comprising a first connector element and a second connector element, said first and second connector elements of each of said plural releasable connectors being arranged to be slid with respect to each other to releasably secure them together, each of said leg frame panels having at least one of said first and second connector elements fixedly secured to said side edge thereof, each of said corners of said core frame unit including at least one of said first and second connector elements fixedly secured thereto, whereupon each of said leg frame panels may be releasably secured to any corner of said core frame unit by causing the at least one connector element at the side edge of said leg frame panel unit to slidably engage the at least one connector element at the corner of said core frame unit, whereupon said frame panel is oriented to the core frame unit side-wall panels contiguous with the corner to form a viewing alcove, said at least one support member being arranged to be releasably secured onto at least one of said horizontal rods of said grid.

2. The system of claim 1 wherein said side edge of each of said leg frame panels includes plural of one of said first and second connector elements fixedly secured thereto at spaced locations therealong, and wherein each of said corners of said core frame unit includes plural of the other of said first and second connector elements fixedly secured thereto at spaced locations therealong.

3. The system of claim 1 wherein each of said side-wall panels of said core frame unit has an upper edge and a lower edge, and wherein said core frame unit includes a bottom portion having plural tubular sides, each of said tubular sides being fixedly secured to a respective one of said lower edges of said side-wall panels.

4. The system of claim 1 wherein each of said side-wall panels of said core frame unit has an upper edge and a lower edge, and wherein said core frame unit includes a top portion having plural tubular sides, each of said tubular sides being fixedly secured to a respective one of said upper edges of said side-wall panels.

5. The system of claim 3 wherein said core frame unit includes a top portion having plural tubular sides, each of said tubular sides being fixedly secured to a respective one of said upper edges of said side-wall panels.

6. The system of claim 1 wherein each of said side wall panels of said core frame unit is planar.

7. The system of claim 1 wherein said system additionally comprises a topper frame unit mounted on said core frame unit.

8. The system of claim 7 wherein said topper frame comprises a panel formed of a grid of intersecting horizontal and vertical rods.

9. The system of claim 1 additionally comprising plural rollers for facilitating the movement of said rack assembly, and wherein each of said side-wall panels of said core frame unit has a lower end forming a bottom for said core frame unit, said rollers being located on said bottom of said core frame unit.

10. The system of claim 9 wherein said rollers are releasably secured to said bottom of said core frame unit section.

11. The system of claim 1 additionally comprising at least one roller located on each of said leg frame panels.

12. The system of claim 11 wherein said roller is lockable.

13. The system of claim 11 wherein said roller is releasably secured to said leg frame panel.

14. The system of claim 1 wherein one of said first and second connector elements comprises a bracket member and the other of said connector elements comprises a plate, said bracket member having a throat into which the plate is arranged to be slid to releasably secure said first and second connector elements to each other.

15. The system of claim 14 wherein said bracket members are fixedly secured to said leg frame panels.

* * * * *